United States Patent [19]

Berg

[11] Patent Number: 4,911,605

[45] Date of Patent: Mar. 27, 1990

[54] DRUM CLAMPING UNIT FOR L RING DRUM

[75] Inventor: Bruce A. Berg, Lake Forest, Ill.

[73] Assignee: Liftomatic Material Handling, Inc., Evanston, Ill.

[21] Appl. No.: 217,972

[22] Filed: Jul. 12, 1988

[51] Int. Cl.[4] ..... B66F 9/06

[52] U.S. Cl. ..... 414/623; 414/607; 414/626; 294/90

[58] Field of Search ..... 414/618, 619, 620, 621, 414/622, 623, 626, 607, 408, 409, 406, 422; 294/31.1, 67.3, 81.61, 81.51, 87.1, 87.22, 901, 902, 87.24, 90, 110.1, 110.2

[56] References Cited

U.S. PATENT DOCUMENTS

| | | | |
|---|---|---|---|
| 2,272,447 | 2/1942 | Traxel | 414/450 |
| 3,158,275 | 11/1964 | Hart | 414/623 |
| 3,338,616 | 8/1967 | Ericson . | |
| 3,718,228 | 2/1973 | Lund et al. . | |
| 3,785,692 | 1/1974 | Ericson | 294/90 |
| 4,018,468 | 4/1977 | Lundquist | 414/607 X |
| 4,130,212 | 12/1978 | Gatilao | 414/607 X |

FOREIGN PATENT DOCUMENTS

| | | | |
|---|---|---|---|
| 3312463 | 2/1984 | Fed. Rep. of Germany | 294/90 |
| 893998 | 4/1962 | United Kingdom | 187/9 R |

*Primary Examiner*—Frank E. Werner

[57] ABSTRACT

A drum clamping unit for plastics material drums with peripheral "L'8 chime rings below the drum head is adapted to be mounted on suitable lifting and transporting devices such as lift trucks, overhead cranes, and the like to automatically engage, latch onto, and discharge one or more of the molded plastics material drums without damaging the drums. The unit has a plurality of clamping jaws automatically triggered to clamping positions by the drum heads as the unit is lowered alongside the drums. These clamping jaws are positioned to engage only with the bottom and inner face of the "L" chime ring of each drum and remain clear of the drum head and drum periphery thereby avoiding any damage to the drums especially as they are raised to clamp onto the "L" rings. Then, when the raised clamped drums are conveyed to and lowered on a desired location, the jaws are released, retracted automatically and held in a retracted position until the unit is again lowered to engage a drum head in a subsequent operation. A preferred unit handles up to four upright drums positioned in a ring cluster or nest.

10 Claims, 5 Drawing Sheets

DRUM CLAMPING UNIT FOR L RING DRUM

BACKGROUND OF THE INVENTION

1. FIELD OF THE INVENTION:

This invention relates to the art of clamping devices especially adapted for use with lifting and transporting equipment to automatically clamp onto drums with peripheral "L" chime rings, lift the drums, and to then automatically release the drums as they are deposited at a desired location. The invention specifically deals with drum clamping units for use with molded plastic drums having "L" shaped peripheral chime rings spaced below the heads of the drums.

2. THE PRIOR ART:

Drum clamping and lifting equipment for a single drum or a cluster of drums is generally known in the art from the teachings of the Ericson U.S. Pat. No. 3,338,616 and the Lund and Ericson U.S. Pat. No. 3,718,228. The teachings of these patents are directed to devices for clamping and lifting conventional drums with raised steel rims around the drum heads. These devices were triggered by engagement with these rims to swing a top jaw over the drum head against the inner periphery of the rim and to lift a bottom jaw along the periphery of the drum to engage the bottom of the rim. The rim on the drum head had to be a strong and rigid projection unimpeded both radially and axially to receive the jaws and the trigger mechanism. Since the rims were restricted to the diameter of the drum head, the jaws had to be narrow to grip the rim without deforming it.

This equipment was useless for lifting the now popular lightweight molded plastic drums which have peripheral chime rings below the drum heads. These chime rings are "L" shape in cross section and surround the drum peripheries so that while they are radially impeded they also have a larger diameter than the drum and can accept wider jaws.

It would therefore be an improvement in this art to provide drum clamping units adapted to be suspended from drum lifting and conveying equipment, such as fork trucks, cranes, and the like, which will align itself alongside a single drum or between a ring cluster or nest of drums as it is being lowered, will automatically trigger clamping jaws into clamping positions as it engages the drum heads, will latch the jaws onto peripheral "L" shaped chime rings of the drums as it is raised and will then automatically release the drums when they are again lowered onto a support surface. The jaws are held in retracted positions after releasing the drums and are automatically extended into gripping positions when the trigger mechanism again engages the heads of the next group of drums.

It would especially be an improvement in this art to provide automatic drum clamping equipment for molded plastic drums having peripheral chime rings of "L" shape cross section spaced below the drum heads.

SUMMARY OF THE INVENTION

According to this invention, drums with "L" chime rings around their peripheries are automatically clamped singly or in clusters, lifted, conveyed and then released without deformation or damage. The devices of this invention are especially adapted to handle up to four drums in upright position They are lowered alongside of drums to be lifted and they have guides to maintain the drums in upright position as they are lifted.

Clamping jaws for latching onto the chime rings of the drums are held in retracted position until a triggering mechanism engages the drum heads whereupon the jaws are released to clamping positions. Then, when the device is raised, the jaws will automatically grip the inner periphery and the bottom of each chime ring. Next, when the drums are again lowered to rest on bottom support surfaces, the clamping jaws are released and are automatically retracted and held in this retracted position as the devices are lifted away from the drums. Mechanism holds the jaws in their retracted position until they are again activated by the trigger mechanism again engaging drum heads. The devices have four quadrant recesses for the drum peripheries providing a generally tubular assembly with peripheral skids that easily embrace the drum peripheries. Suspension mechanism for the device accommodates lateral shifting to center the skids between a cluster of drums.

The clamping jaws are relatively wide so that they will not bite into the plastic chime ring.

The invention will be more fully understood by the following descriptions of the attached sheets of drawings showing a preferred embodiment of the invention in which.

BRIEF DESCRIPTION OF THE DISCLOSED EMBODIMENTS

Figure 1:
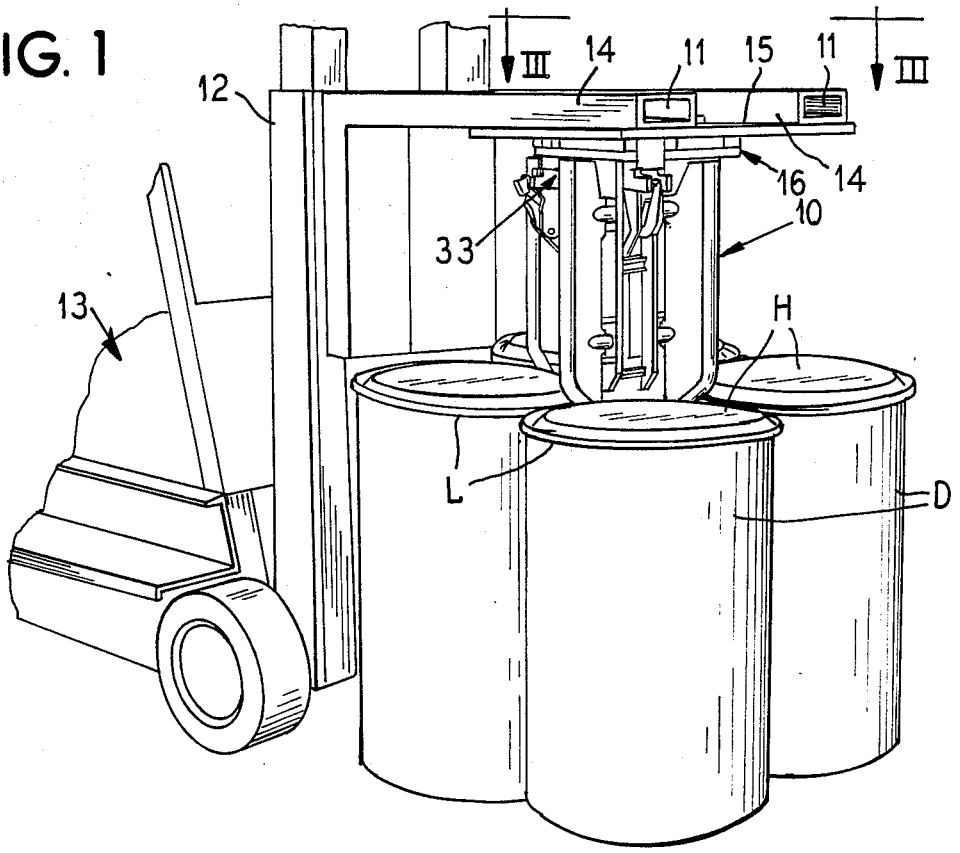
FIG. 1 is a fragmental front and side perspective view of a clamping unit of this invention suspended from the forks of a lift truck and showing the unit as it enters the top of the central space between a ring cluster or nest of four upright molded plastic drums with peripheral "L" shaped chime rings below the drum heads.
Figure 2:
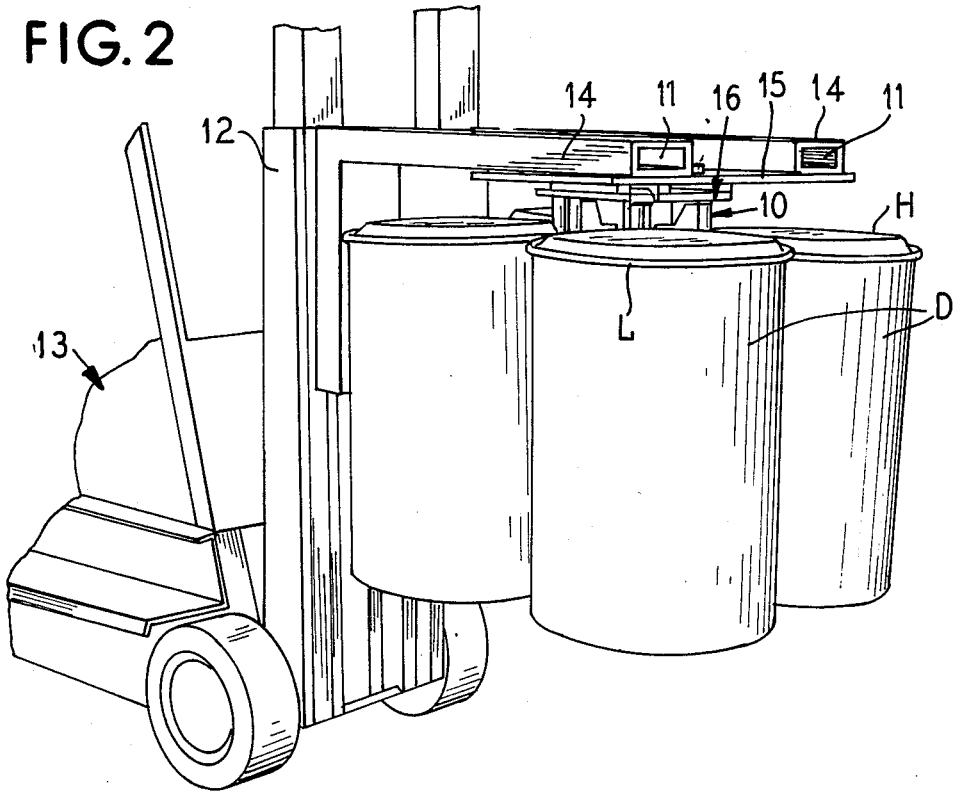
FIG. 2 is a view similar to FIG. 1 but showing the unit after it has clamped onto chime rings of the four drums and raised them above the floor for transportation.

As shown in FIGS. 1 and 2, the clamping device 10 of this invention is mounted on the forks 11, 11 of a vertical lift mast 12 on the front end of a lift truck 13. As is customary on such trucks, the mast 12 mounts and lifts a pair of spaced parallel forwardly projecting forks 11, 11. These forks are inserted in shoes 14, 14 secured on a centrally apertured top horizontal mounting plate 15 of the clamping unit 10.

It will be understood that, instead of suspending the plate 15 on the forks of a lift truck, it can be suspended from a crane or other carriage mechanism capable of lifting and transporting the clamp device 10.

Figure 3:
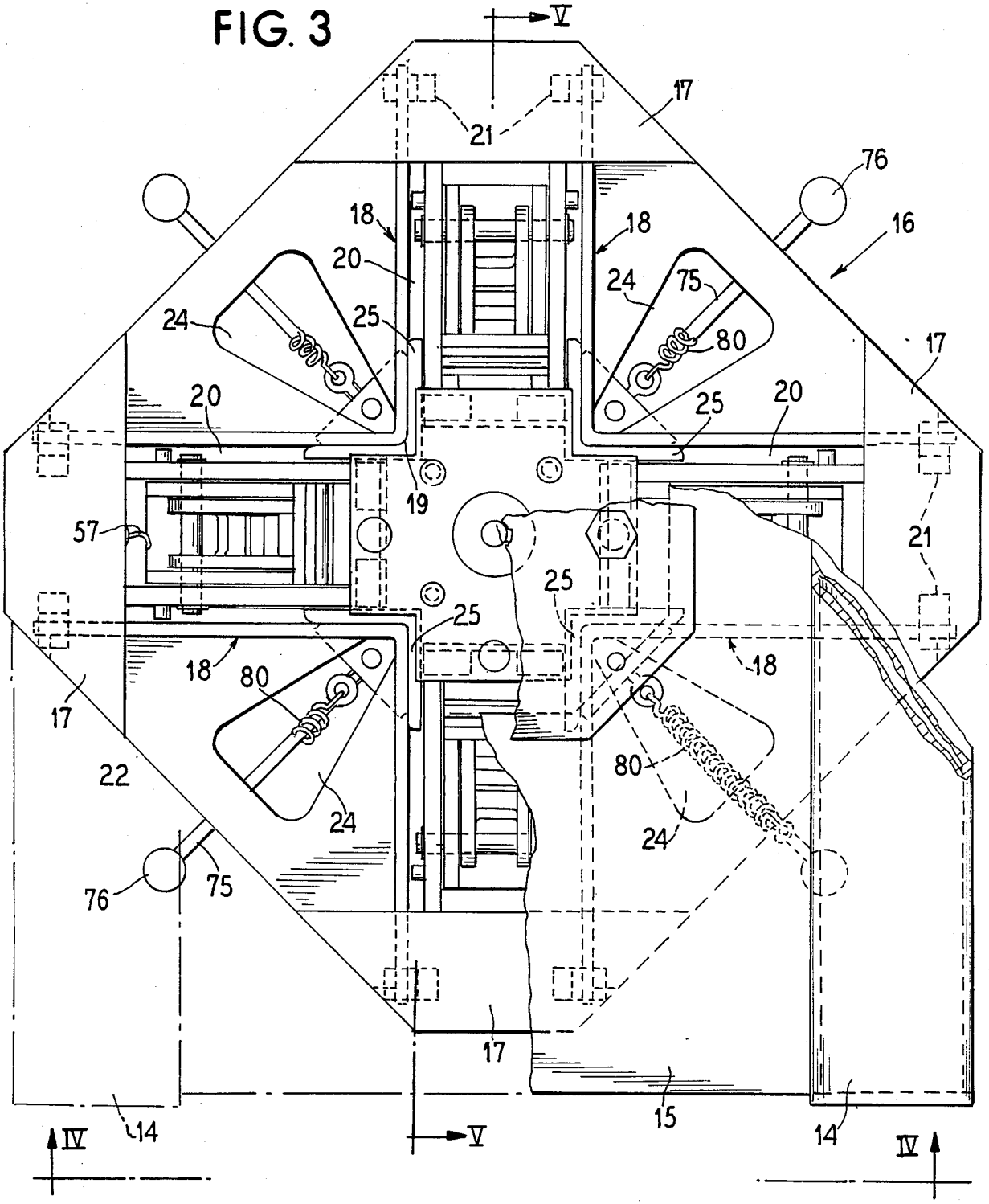
FIG. 3 is a top plan view generally along the line III—III of FIG. 1 with parts broken away to show underlying structure.
Figure 4:
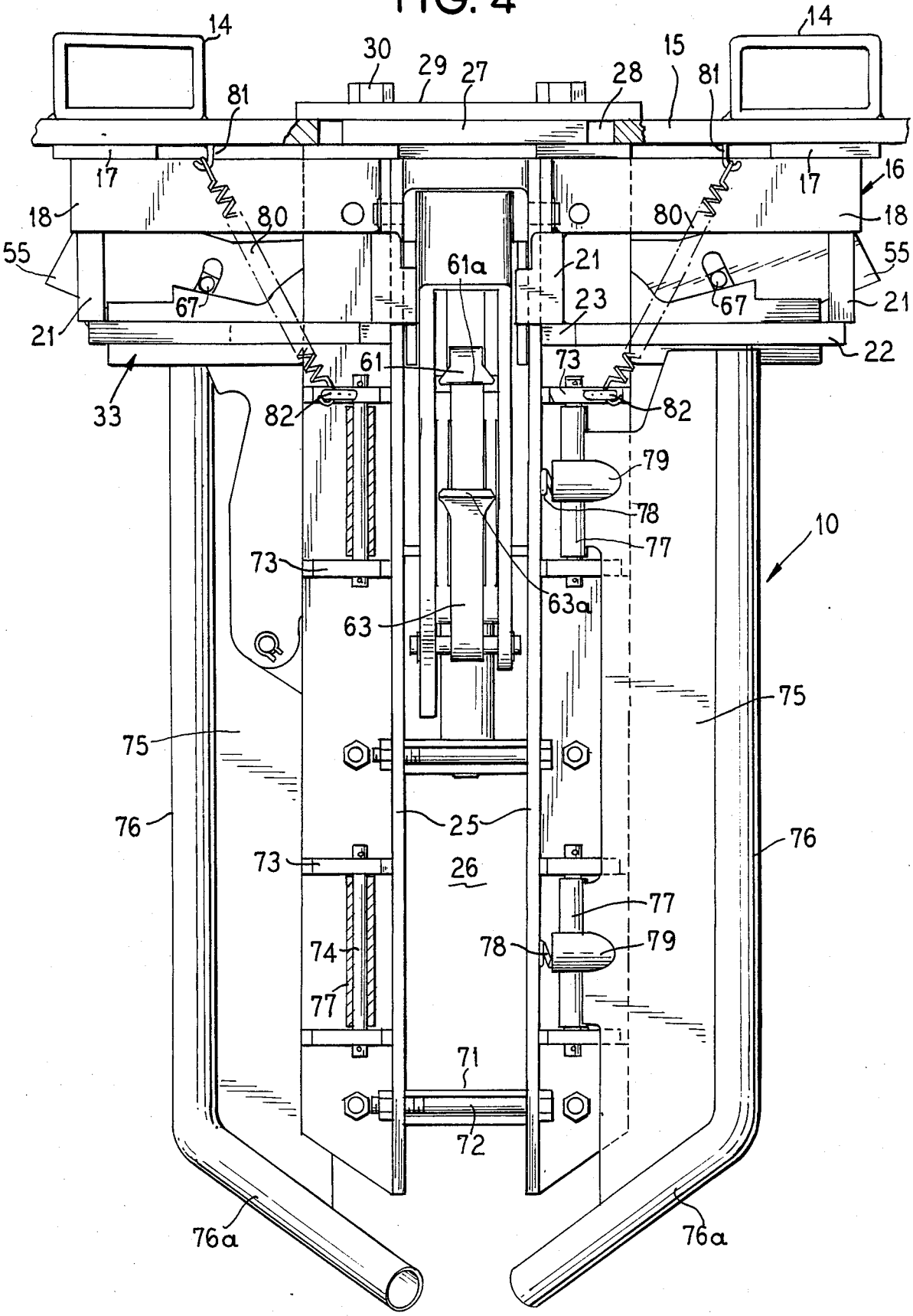
FIG. 4 is an elevational view along the line IV—IV of FIG. 3.
Figure 5:
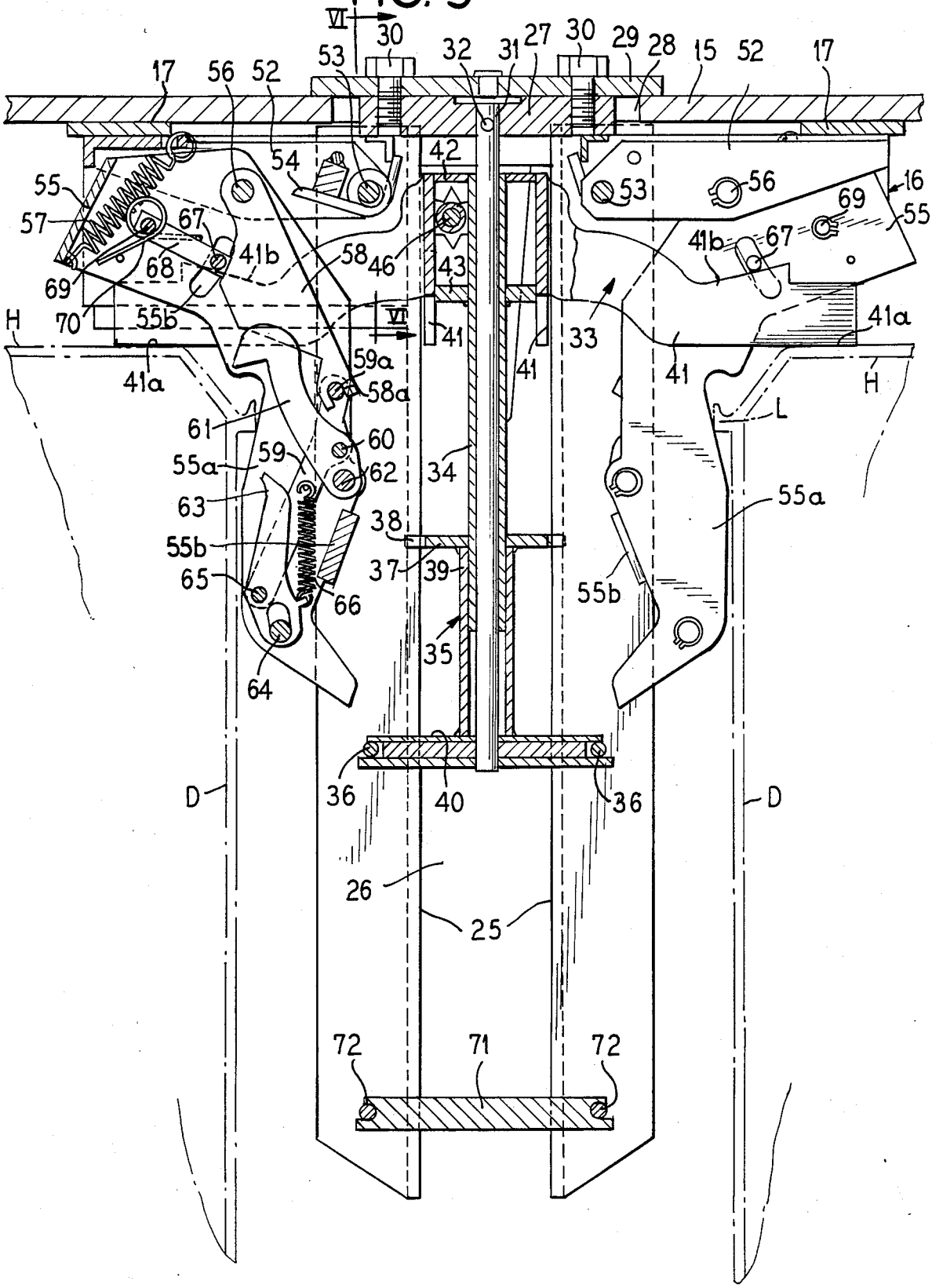
FIG. 5 is a vertical sectional view generally along the line V—V of FIG. 3.

A rigid top frame structure 16 for the unit 10 is suspended from the plate 15 and adapted to shift laterally thereunder. This frame 16 as shown in FIGS. 3–5 has four top shoes 17 at the corners thereof riding against the under face of the plate 15. Four vertical angle iron plates 18, arranged in cruciform relation to provide a square open center 19 with four radiating channels 20, (FIG. 3) have the tops of the outer ends of their legs welded to the undersides of the shoes 17.

Two laterally spaced upright blocks 21 are welded to the bottom edge of each angle iron plate 18 and to the top face of a horizontal, substantially square, plate 22.

The frame 16 may thus be viewed as having a square horizontal base plate 22 with eight upstanding peripheral blocks 21 suspended from the bottoms of the outer ends of the four angle irons 18 which radiate from a square central opening 19 in cruciform relation providing four channels and with the tops of adjacent pairs of the angle irons 18 secured to and spanned by the shoe plates 17.

The bottom plate 22 of the frame 16 has a central aperture 23 and four triangle shaped apertures 24 with apexes underlying corners of the angle irons 18.

Four elongated angle iron strips 25 overlie and are secured to the corners of the angle irons 18 and depend therefrom substantially below the base plate 22 of the frame through the aperture 23 thereof. These four plates 25 provide an open ended tubular core space 26 the top of which is closed by a head cap 27 which projects freely through a circular central opening 28 in the suspension plate 15 (FIGS. 4 and 5).

The head or cap 27 is notched at the bottom face thereof to fit in the top of the core space 26 and to overlie the top edges of the angle iron plates 25 and is securely welded to these angle iron strips or plates.

A suspension plate 29 overlies the cap 27 and is secured to the top face thereof by bolts 30. This plate 29 is of larger diameter than the aperture 28 and rides on the suspension plate 15. The arrangement is such that the frame 16 of the unit 10 can slide laterally under the plate 15 with the shoes 17 riding on the underface of this plate.

A central post 31 is suspended from the center of the cap 27 and fixed thereto by a cross-bolt 32. This post slideably guides a spider 33 the spider 33 having a central upright tube 34 embracing the post 31 and in turn slideable in a fixture 35 supported on bolts 36 from the angle strips 25. This fixture 35 has a top plate 37 with peripheral notches 38 receiving the corners of the angle iron strips 25. A tube 39 depends from this top plate 37 to slideably embrace the tube 34. The bottom of this tube 39 is welded to a plate assembly 40 composed of a sandwich of three plates with the top and bottom plates providing recesses to seat the bolts 36.

The spider 33 is composed of four radiating arms 41 notched together at their centers to provide an open channel cruciform arrangement aligned with the four channels 20 of the angle irons 18. The bottom edges **41*a* of these arms 41 are positioned to engage the heads H of drums D to be clamped and raised as shown in FIG. 5. The top edges of these arms are provided with cam surfaces 41*b*** to trigger clamping mechanism as will be hereinafter described.

The four spider arms 41 are mounted on the upright tube 34 through top and bottom plates 42 and 43 shown in FIG. 5. The arrangement is thus such as to accommodate vertical sliding of the spider 33 relative to the frame 16 on the post 31 for a stroke having a top at the bottom face of the head 27 where it is engaged by the plate 42 to a bottom where the tube 34 would engage the plate 40. In other words, the spider 33 in its free suspended position of FIG. 1 would drop to the bottom of its stroke with the tube 34 supported on the bottom plate 40 and then as the unit is lowered to engage the bottom edges **41*a* of the spider arms 41 with the tops H of the drums, further lowering of the spider 33 is arrested and continued lowering of the frame 16 will engage the head 27** with the top of a spider assembly.

The stroke of the spider 33 is controlled by latching mechanism which holds and releases the spider to perform its function activating and retracting the clamping jaws as will be further described.

Figure 6:
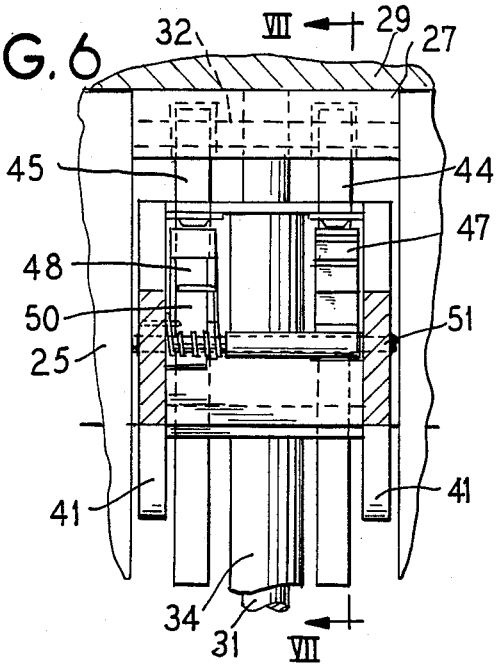
FIG. 6 is a fragmentary elevational view taken generally along the line VI—VI of FIG. 5.
Figure 7:
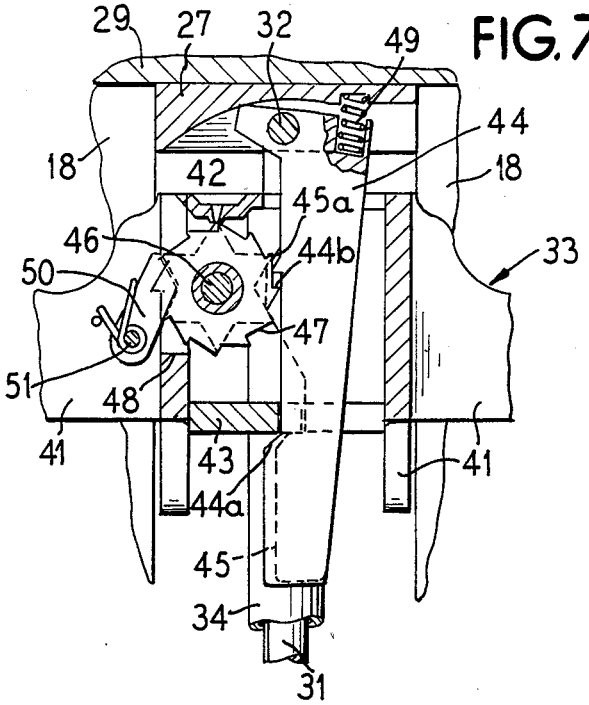
FIG. 7 is a sectional view taken generally along the line VII—VII of FIG. 6.

This latch mechanism includes a pair of side-by-side fingers 44 and 45 suspended from the pin 32 of the head 27 as shown in FIG. 6. The bottom of the head 27 is recessed as shown in FIG. 7 to permit these fingers to swing. A shaft 46 spans the central tubular space between the four spider arms 41 and is rotatably mounted at its ends in the arms in front of the fingers 44 and 45. A ratchet wheel 47 and a star wheel 48 are pinned to this shaft 46 to rotate therewith. A spring 49 (FIG. 7) tilts the finger 44 against the ratchet wheel 47.

A spring loaded pawl 50 on a shaft 51 also carried by the spider arms is pressed against the star wheel 48. As shown in FIG. 7 the finger 44 has a cam edge **44*a* which latches under the plate 43 to hold the spider 33 near the top of its stroke. Then when the spider arms 41 are lowered to rest on the tops H of the drums D and the frame 16 continues to be lowered, a tooth 44*b* on the finger 44 will engage a tooth of the star wheel 48 to rotate the wheel in a clockwise direction as viewed in FIG. 7. This rotation of the star wheel will also rotate the ratchet wheel 47 causing one of its points to engage a cam surface 45*a* of the finger 45 swinging the finger to the right as viewed in FIG. 7 and thus also tilting the finger 44 so that its cam 44*a* will be free from the plate 43. Then, as the main frame 16 is raised the spider 33 can drop to the bottom of its stroke. The arrangement is such that the spider 33 is held near the top of its stroke, is lowered to rest on the drums, whereupon continued lowering of the frame will release the spider for dropping to the bottom of its stroke when the frame is again raised. Then, when it is again lowered to deposit the drums it will be raised from the bottom of its stroke and the star wheel will be driven to permit its finger to swing to the left carrying the finger 44 therewith into position for again latching onto the plate 43**. This relative movement of the spider and its supporting frame will activate clamping jaws as hereinafter described.

A beam 52 (FIG. 5) is provided in each of the channels 20 of the cruciform arms provided by the angle plates 18 and is suspended on a pin 53 carried by the angle plates 18. Springs 54 embracing the pins 53 raise these beams against the underfaces of the shoe plates 17. Channel jaw casings 55 are pivotally suspended from these beams 52 on pins 56. Tension springs 57 urge these jaw casings 55 to swing about their pivots 56 to hold their depending tail portions **55*a* in upright positions. The sidewalls of the channel casings are connected by a reinforcing strap 55*b* spanning the tail portions 55*a*** of the channel.

The pins 56 also swingably suspend a control lever 58 between the sides of the casing 55. A link 59 pivoted on a pin 60 carried by the sidewalls of the tail portion **55*a* of the casing 55 has a transverse pin 59*a* spanning the top end thereof embraced by the bifurcated end 58*a* of the lever 58. A top jaw member 61 pivoted on a pin 62 carried by the sidewalls of the tail portion 55*a* of the casing 55 is also pivoted on this link 59 at 60**.

A lower jaw 63 is pinned at 64 to the casing tail 55A. A pin 65 then connects this lower jaw 63 with the bottom end of the link 59. A spring 66 anchored at its bottom end to the lower jaw 63 and at its top end to the link 59 pulls the lower jaw about its pin 64 to an upright position.

A pin 67 rides on the cam surface **41*b* of the spider arm 41 and projects freely through slots 55*b* in the sidewalls of the casing 55. This pin is carried on a lever 68 from a pin 69 mounted in the sidewalls of the casing 55. A hairpin spring 70 embracing the pin 69 biases the pin 67 to the bottoms of the slots 55*b* in the jaw casing 55**.

The arrangement is such that as the pin 67 is raised by the cam surface **41*b* of the spider arm 41 against the bias of the spring 70 it will ride on the cam surface of the control lever 58 swinging it about the pin 56 and causing the bifurcated end 58*a* of the lever to drive the pin 59*a* of the link 59 swinging the link about the pivot 60 and driving the jaw 61 outwardly. At the same time the lower end of the link 59 will swing outwardly to drive the lower jaw 63 outwardly about its pivot 64**.

It should thus be understood that the jaw casings 55 are pivotally suspended from the cantilever beams 52 which in turn are pivotally suspended from the angle plates 18 and are biased by the springs 54 against the shoe plates 17 until the jaws begin to lift the drums D whereupon the beams 52 pivot downwardly away from the plates 17. Prior to the lifting of the drums the springs 57 hold the jaw casings 55 in an upright position with the jaw assembly retracted in the casing. Then when the spider engages the drum heads, the pin 67 will be raised by the cam surface **41*b* of the spider arm triggering the jaws outwardly into latching positions. Then when the frame 16 is elevated these jaws will be driven into clamped engagement with the chime rings "L" of the drums with the top jaw 61 fitting into the open top channel of the chime ring and the bottom jaw 63 abutting the bottom face of the chime ring. When the drums are again deposited the spider will again engage the drum head and as the frame 16** is further lowered, the jaws will be released from the chime rings "L" and held in retracted position.

The chain of movements in the mechanism that actuates the jaws is initiated when the unit is lowered into a nest of four drums as illustrated in FIGS. 1 and 2. When the bottom edges **41*a* of the spider arms 41 engage the tops H of the drums D, continued lowering of the unit causes the cam surfaces 41*b* on the tops of the spider arms 41 to engage the pins 67 of the jaw casings 55 transmitting movement to the cantilever control arms 58 and then through links and pins to the jaws 61 and 63. In a cycle of strokes the spider 33 engages the head 27 at the top of its stroke and then as the unit 16 is raised the head 27 moves upwardly away from the spider for about a quarter of a stroke whereupon continued raising of the unit will cause ledge 44*a* of the arm 44 to engage the underface of the plate 43 thus raising the spider with the frame 16**. At this point the jaws are held open and upward for a quarter stroke and a full downward stroke actuates the jaws to close for clamping.

The ratchet mechanism is pinned to and rotates inside the spider with the pawl 50 spring-loaded to engage the star wheel 48 driving it a distance of one tooth on the upstroke and also causing it to rotate the ratchet wheel 47 swinging the other arm 44. In each full upward stroke the ratchet engages the tooth on the hook of the arm 44 and is rotated. Momentary rotation stops at exact intervals and is controlled by the spring-loaded pawl 50. In a full cycle the cam has two interval stop positions. In one position of the cam a lobe of the star wheel is positioned directly pointed at and positioned against the cam 45 causing it to swing away. In the other position the valley between the two lobes of the star wheel allows the arm to settle in. The drawn in position allows the hook to engage the underside of the spider stopping at its full downward stroke. The jaws are momentary held open at this position and in the next upward position the holding pawl is pushed away releasing the spider for a full downward stroke. Then the jaws will close and be in a clamping mode.

As shown in FIG. 4, the jaws 61 and 63 have relatively wide heads **61*a* and 63*a*** respectively engaging the inner groove and exterior bottom of the "L" chime ring of the drum D to span a larger periphery zone of the ring to minimize peripheral deformation of the ring. Widths of $1\frac{1}{4}$–$1\frac{1}{2}$ inches are useful for the "L" chime whereas only about $\frac{3}{4}$ inch could be tolerated by the steel rim of the conventional drum.

As shown in FIGS. 4 and 5, the lower ends of the angle arm plates 25 are joined by a reinforcing bottomhead 71 spanning the core space 26 and are secured to the plates by bolts 72.

Figure 8:
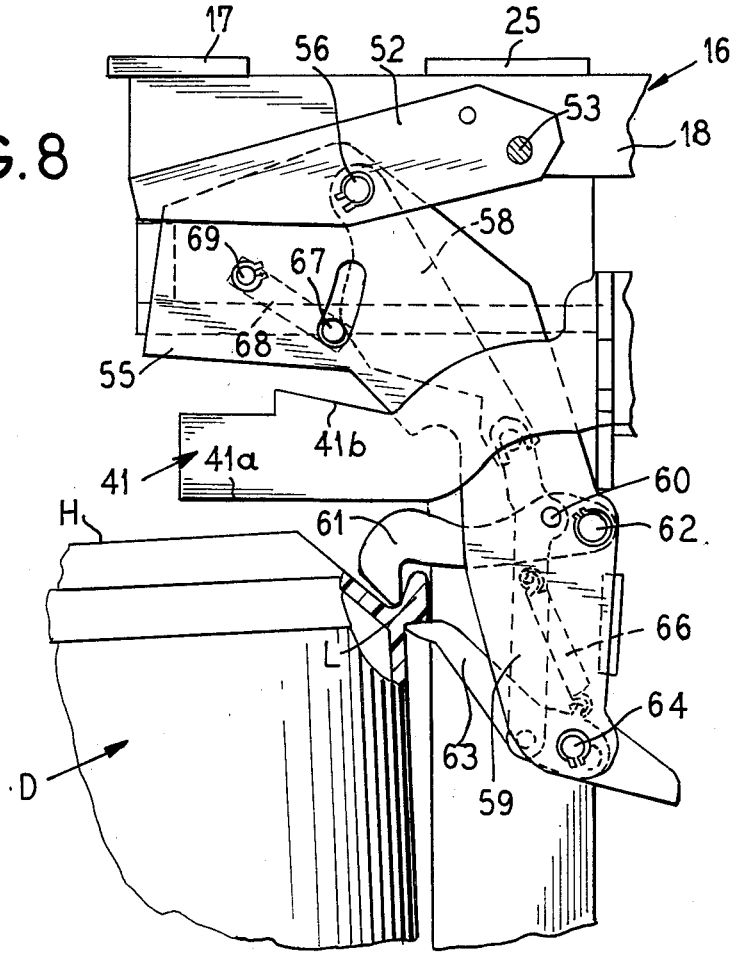
FIG. 8 is a somewhat enlarged fragmentary elevational view of the set of clamping jaws shown in FIG. 5 but illustrating them in their clamping or locked position.

As shown in FIG. 4, the angle plates 25 have pairs of brackets 73 radiating therefrom carrying upright pins 74 on which are swingably mounted upright plates 75 with rounded outer upright skid tubes 76 having inturned ends **76*a*. These members 75 have upright hubs 77 swingable on the pins 74. A spring 78 in a cup-like housing 79 on each hub 77 urges the member 75 radially outward but accommodates limited vertical swinging of the members. The arrangement is such that the skid tubes 76 will ride along the sides of the drums holding them in tilted but upright position as they are raised as shown in FIG. 8, but the plates and tubes can swing to embrace a quadrant to the drum periphery and bring the drum in line when it is lifted. As pointed out above, the cantilever beams 52 are pulled downwardly when the drums are lifted and this swings the suspended jaw casing 55** into position to clamp the jaws.

The frame assembly 16 is centered on the plate 15 by tension springs 80 attached at their upper ends to hooks 81 on the plate 15 and at their lower ends two hooks 82 on the top brackets 73. These springs accommodate limited shifting of the frame assembly 16 under the plate 15 lateral permitting entry of the lower ends **76*a* of the tubes 76** into the central open space between a cluster of four drums D. Exact alignment of the unit with the central space is then not required.

From the above descriptions it should be readily understood to those skilled in this art that the units of this invention will clamp, lift, deposit, and release drums with peripheral "L" shaped chime rings which cannot be handled by prior known lifting devices.

I claim as my invention:

1. A drum lifting machine for drums having "L" type peripheral chime rings below the drum head, said machine adapted to automatically grip the "L" chime ring of the drum, lift and convey the gripped drum and then deposit, automatically release the drum and retain the gripping mechanism in retracted condition to clear the "L"-shaped chime ring of the drum for the next operation which comprises a head plate adapted to be suspended above the head of the drum to be lifted from a power lift device, lifting mechanism suspended from said head plate for relative lateral movement, said lifting mechanism including a head frame, a spider assembly mounted for vertical movement on the head frame through a restricted stroke and positioned to rest on the head of the "L" chime ring drum when the head frame is lowered to raise the spider relative to the head frame through said restricted stroke, beams pivotally suspended on the head frame, clamping mechanism suspended from the beams having upper and lower jaws respectively sealable in the top of the "L"-shaped chime ring of the drum and engaging the exterior bottom of the chime ring, and cams on the spider for actuating the clamping mechanism to first swing the jaws outwardly into grip relation with the chime ring and to grip the chime ring when the head frame is raised, and to then release the jaws from the chime ring and retract the jaws when the head frame is again lowered with the spider resting on the drum head and to retain the jaws in retracted position for a subsequent lifting operation.

2. A drum clamping unit with latching mechanisms for latching onto the chime rings of drums having "L" type peripheral chime rings below their drum heads and adapted to be mounted on lifting and conveying equipment to automatically grip the "L" chime rings of the drums, lift and convey the gripped drums and then deposit, automatically release the drums, and retain the latching mechanism in retracted condition to clear the "L"-shaped chime rings of the released drums and drums to be subsequently lifted which comprises a top frame structure for overlying the drums, upstanding circumferentially spaced skids suspended from the top frame structure and swingably mounted about the periphery of the unit for engaging the sides of the drums to be lifted to hold them in an upright position, a spider suspended from said top frame structure adapted to shift vertically relative thereto through a limited stroke, said spider having top and bottom edges, a plurality of circumferentially spaced cantilever beams pivotally suspended from said frame for vertical swinging movement, spring means urging each of said beams upwardly against the frame, a jaw casing pivotally suspended from each beam, springs urging the jaw casings into upright positions, top and bottom jaw members suspended from the jaw casings, linkage mechanism controlled by the stroke of the spider holding the jaw members in retracted open position inwardly from the skids, said bottom edge of said spider engageable with the tops of the drums to support the spider as the frame is lowered, and cam surfaces on said top edges of the spider actuating the jaw casings as the frame is lowered relative to the drum supported spider to trigger the jaw members into latching engagement with the "L" type peripheral chime rings of the drums.

3. A clamping unit for latching onto the "L"-shaped chime ring around the periphery of a drum and spaced below the drum head without damaging the drum which comprises a main horizontal frame adapted to be suspended over the tops of drums to be lifted from a lifting device such as a fork lift truck which comprises a generally tubular shaped unit having circumferential skids for embracing quadrants of upright drums, clamping jaws suspended from said unit adapted to engage the inner periphery and bottom wall of the "L"-shaped peripheral below drum head chime rings of the plurality of drums to be lifted, a spider suspended from the top of said unit for limited vertical movement, said spider adapted to rest on the tops of the heads of drums to be lifted, mechanism triggered by lowering of the frame relative to the spider when the spider rests on the tops of the drum heads to move through said limited vertical movement of the spider relative to the frame actuating said clamping jaws is into latched engagement with the chime rings of the drums, and holding the jaws in latched engagement with the chime rings when the unit is raised to lift the drums, mechanism to release the jaws when the drums are again deposited, and mechanism to hold the jaws in released position laterally outward from the "L"-shaped chime rings of the drums until the spider against engages drum heads.

4. The machine of claim 1 including upstanding skids swingably mounted around the periphery of the lifting mechanism for engaging the sides of the drums to hold them in upright position.

5. The machine of claim 1 wherein the upper and lower jaws have wide ends spanning a substantial circumferential area of the chime ring gripped thereby.

6. The lifting machine of claim 1 including four sets of clamping mechanism for simultaneous gripping and releasing four drums in a cluster around the machine.

7. The latching mechanism of claim 2 including four sets of top and bottom jaw members for engaging the chime rings of four drums.

8. The unit of claim 2 wherein the top frame has a head limiting the top of the stroke of the spider and the top frame carries a support limiting the bottom of the stroke.

9. The unit of claim 3 wherein the skids are mounted for circumferential swinging.

10. The unit of claim 3 wherein the spider has cam surfaces actuating the clamping jaws only after the spider rests on a drum head and the frame is lowered relative to the spider.

* * * * *

UNITED STATES PATENT AND TRADEMARK OFFICE

CERTIFICATE OF CORRECTION

PATENT NO. : 4,911,605

DATED : March 27, 1990

INVENTOR(S) : Bruce A. Berg

It is certified that error appears in the above—identified patent and that said Letters Patent is hereby corrected as shown below:

Title page:

IN THE ABSTRACT:

Line 2, delete "L'8 and insert --"L"--;

IN THE SPECIFICATION:

Column 1, line 66, after "upright position" insert --.--;

Column 6, line 4, delete "cam" and insert --arm--;

IN THE CLAIMS:

Claim 1, column 7, line 8, delete "sealable" and insert --seatable--;

Claim 3, column 8, line 13, delete "the" and insert --a--;

Claim 3, column 8, line 21, delete "is" after "jaws";

Claim 3, column 8, line 28, delete "against" and insert --again--;

UNITED STATES PATENT AND TRADEMARK OFFICE

CERTIFICATE OF CORRECTION

PATENT NO. : 4,911,605

DATED : March 27, 1990

INVENTOR(S) : Bruce A. Berg

It is certified that error appears in the above-identified patent and that said Letters Patent is hereby corrected as shown below:

Claim 6, column 8, line 38, delete "mechanism" and insert --mechanisms--;

Signed and Sealed this

Nineteenth Day of March, 1991

*Attest:*

HARRY F. MANBECK, JR.

*Attesting Officer*

*Commissioner of Patents and Trademarks*